United States Patent [19]

Mauthe

[11] Patent Number: 4,658,108

[45] Date of Patent: Apr. 14, 1987

[54] GAS-BLAST SWITCH

[75] Inventor: Gerhard Mauthe, Birmenstorf, Switzerland

[73] Assignee: BBC Brown, Boveri & Company Ltd., Switzerland

[21] Appl. No.: 777,314

[22] Filed: Sep. 18, 1985

[30] Foreign Application Priority Data

Sep. 26, 1984 [CH] Switzerland ..... 4610/84

[51] Int. Cl.[4] ..... H01H 33/88

[52] U.S. Cl. ..... 200/148 A; 200/148 R

[58] Field of Search ..... 200/148 R, 148 A

[56] References Cited

U.S. PATENT DOCUMENTS 4,475,018 10/1984 Arimoto et al. ..... 200/148 A

FOREIGN PATENT DOCUMENTS 3132825 1/1983 Fed. Rep. of Germany ... 200/148 A

*Primary Examiner*—Robert S. Macon

*Attorney, Agent, or Firm*—Ostrolenk, Faber, Gerb & Soffen

[57] ABSTRACT

A gas-blast switch, preferably suitable for switching high voltages, has two arc contacts which can be moved relatively to each other along an axis. Also included are a heating volume and a compression volume concentrically formed around the axis. Quenching gas is compressed in the compression volume by means of a compression slider. As soon as the gas pressure is sufficiently high, a part of the quenching gas flows via a back-pressure valve into the heating volume and there assists in blasting an arc drawn between the arc contacts during a switching-off process. The assist is needed primarily when only small currents are involved in which case only comparatively low quenching gas pressure is developed in the heating volume. The switching-off capacity of the gas-blast switch is increased with simultaneous reduction in the needed actuating energy. This is achieved in that the arc contact of a moving contact member has a discharge duct which extends in axial direction from a free end facing a fixed contact member to another end which opens into the expansion. volume. Between the compression volume and the expansion volume a device is provided for controlling the pressure and for refilling the quenching gas located in the compression volume.

9 Claims, 2 Drawing Figures

GAS-BLAST SWITCH

BACKGROUND AND SUMMARY OF THE INVENTION

The present invention relates to a gas-blast switch.

Such a gas-blast switch is already known from U.S. Pat. No. 4,139,732. In this switch, heated and compressed quenching gas is stored in a heating volume after the switching arc is switched off. During the switching off operation, compressed quenching gas is additionally generated by the movement of a compressor piston in a compression space joined to the heating volume via a back-pressure valve. This measure makes it possible to achieve a quenching of the switching arc with a comparatively low drive energy even when the pressure of the quenching gas, compressed by heating, is low in the heating volume. When high short-circuit currents are switched, the high pressure of the compressed quenching gas stored in the heating volume, however, closes the back-pressure valve and impedes the movement of the compression piston sliding in the compression volume.

European Patent Specification No. 0,035,581, describes a gas-blast switch in which the blast pressure needed for quenching the arc is generated by the arc itself in an arc space and carried via a back-pressure valve into a pressure storage space where it is stored until the blasting starts. In addition, a compression piston is specified which makes available, with a time delay, further compressed quenching gas which is fed via a back-pressure valve into the pressure storage space and from there flows together with the compressed quenching gas generated by the arc itself via a further back-pressure valve into the arc space and from there flows into an expansion space, blasting the arc.

With small switching-off currents, the blasting pressure generated by the arc is low so that the arc space is sufficient for storing it and the back-pressure valve does not open from the arc space to the pressure storage spaced. The compressed quenching gas generated by the compression piston, independently of the magnitude of the switching-off current, flows as previously mentioned through two further back-pressure valves located behind each other into the arc space and from there blasts the arc.

With very large switching-off currents, the gas pressure generated by the arc is so large that both the arc space and the pressure storage space are fully charged by it. Initially, the compressed quenching gas generated by the compression piston can not therefore pass into the pressure storage space since it is at a lower pressure. As a function of stroke the pressure in the compression volume under the compression piston rises further since no release into the pressure storage space can take place. To avoid overloading the switch drive, a further adjustable back-pressure valve is mounted at the compression housing which vents the compression volume directly into the expansion space if the compression pressure is too high. The numerous back-pressure valves, which are partially located in an area which can be reached by hot gases and switching residues, must be considered as weak points since spring defects or erosion of the sealing seats cannot be prevented at these locations.

The invention as characterised in the claims has the objective of creating a gas-blast switch of the just above mentioned type, the switching-off capacity of which is increased with simultaneous reduction of the drive energy.

The gas-blast switch according to the invention is characterised by the fact that the compression pressure is limited or reduced selectively and in a reliable manner before a certain maximum value determining for the drive design is exceeded, without using additional moving parts, and that this at the same time opens the possibility for a particularly effective dual blasting of the switching arc to be quenched. It is also found to be advantageous that the compression slide valve forces are controlled during the entire switching-off stroke in such a manner that excessive stresses are avoided.

Illustrative embodiments of the subject-matter of the present invention are represented by the drawing, in which:

DETAILED DESCRIPTION OF A PREFERRED EMBODIMENT

Figure 1:
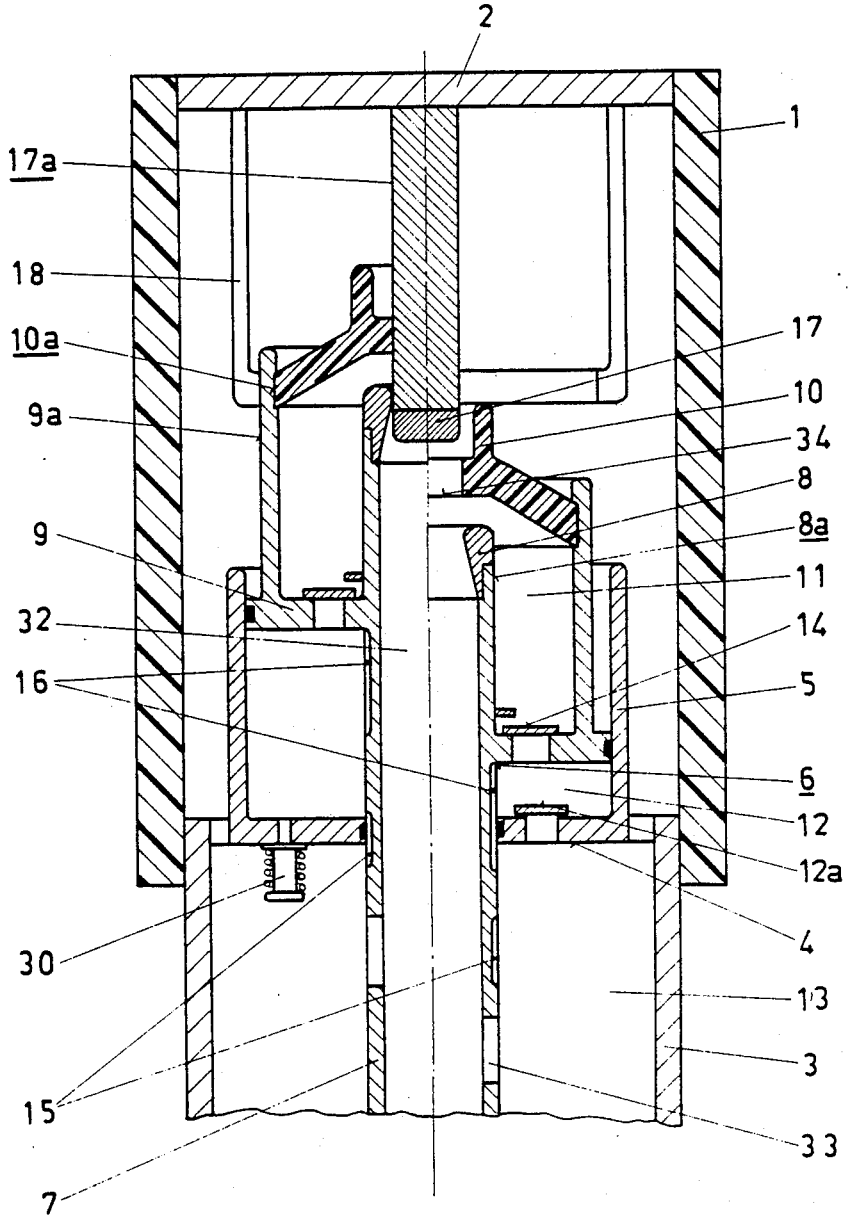
FIG. 1 shows an illustrative embodiment of the gas-blast switch according to the invention.
Figure 2:
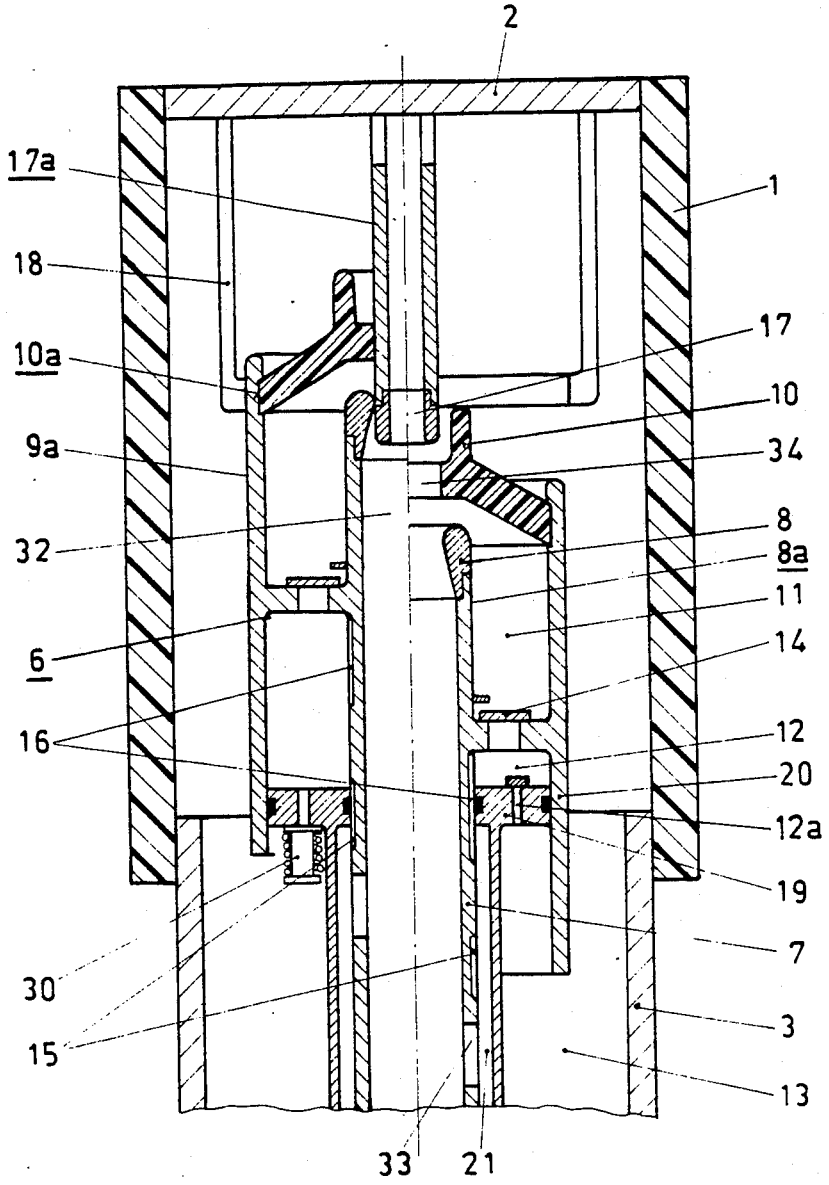
FIG. 2 shows a variation of the gas-blast switch shown in FIG. 1.

FIGS. 1 and 2 show in each case an axial section through a gas-blast switch constructed in accordance with the invention, in which arrangement in each case the switching-off condition is shown on the right-hand side of the center line drawn with dots and dashes and the switching-on condition is shown on the left of this line. In these Figures, identical parts or parts having the same function are given the same reference symbols.

The gas-blast switch according to FIG. 1 has a cylindrical housing 1 which preferably consists of insulating material and which is closed at the top by a metallic connecting flange 2 inserted in pressure-tight manner. The gas-blast switch is closed at the bottom in also pressure-tight manner by a cylindrical metal housing 3, not completely shown. An end wall 4 of the metal housing 3 carries a hollow cylinder 5. A penetration, provided with a piston ring, in the center of the end wall 4 and also the hollow cylinder 5 are used as guides for a compression slider 6 which can be moved upwards and downwards axially by a switch actuator, not shown.

The compression slider 6 consists of a hollow cylindrical shaft 7 at the upper end of which a hollow arc contact 8 of a moving contact member **8*a* is attached, and a compression piston 9 which has a cylindrical continuation, which acts as rated current contact 9*a* of the contact member 8*a*, to the top, into which an insulating nozzle 10 is screwed. Insulation nozzle 10, compression piston 9 and rated current contact 9*a* form a quenching chamber housing 10*a* and define a heating volume 11 coaxially surrounding the arc contact 8. End wall 4, hollow cylinder 5, shaft 7 and compression piston 9 define a compression volume 12. This compression volume 12 can be aspirated from an expansion volume 13 via a back-pressure valve 12*a* mounted in the end wall 4 and can be vented via a back-pressure valve 14 installed in the compression piston 9 in the direction of the heating volume 11. If the pressure in the compression volume 12 exceeds a certain value an excess-pressure valve 30 responds which makes it possible for the excessive pressure to escape into the expansion volume 13. In addition, several grooves 15, 16 are provided in the shaft 7 which in each case vent the compression volume 12 for a short time in the direction of the expansion volume 13. These grooves 15, 16 extend in the axial direction and are constructed to be deeper than wider to keep the mechanical wear of a piston ring sliding over them low. They can also have different lengths and can also be located, at least partially, in the inside wall of the hollow cylinder 5**.

In the switched-on condition, the arc contact 8 and the rated current contact 9*a*, delimiting the quenching chamber housing 10*a* radially outward, engage an arc contact 17 of solid construction and a rated current contact 18 of hollow construction of a contact member 17*a* conductively connected to the connecting flange 2. The rated current path of this gas-blast switch goes from the connecting flange 2 via the rated current contacts 18 and 9*a* to compression piston 9 and further via the shaft 7 to a contact tap, not shown, with a further connecting flange.

In the text which follows, the operation of the invention is explained in greater detail, initially with the aid of FIG. 1:

In the switching-on position (left-hand section of FIG. 1), the compression volume 12 is connected to the expansion volume 13 via the grooves 15 and the pressure of the quenching gas in both volumes can equalize via the grooves 15. As an alternative, this pressure equalisation can also take place through the back-pressure valve 12*a* arranged in the bottom of the hollow cylinder 5. During the switching-off operation, the switch actuator acts on the compression slider 6 and imparts a downward acceleration to the latter. When the rated current contact 9*a* has been separated from the rated current contact 18, the rated current path is interrupted and the current commutates inwards to the arc contacts 8, 17 of the power current path which runs from connecting flange 2 via the arc contacts 17 and 8 to the shaft 7.

This is followed by separation of the arc contacts 8 and 17 and an arc, not shown, is created between the two arc contacts 8, 17. The arc heats up the quenching gas in the heating volume 11 and thus brings it to a higher pressure level while a part of the ionized and contaminated gases is removed from the arc zone via a discharge duct 32 located in the hollow arc contact 8 and in the hollow shaft 7.

If the arc currents are low, the arc energy is possibly not high enough to adequately raise the gas pressure in heating volume 11. For this reason, an additional compression device, which is independent of the arc, is provided for generating compressed quenching gas and provision is made by suitable dimensioning of the length of the discharge duct 32 between the free end, facing the fixed contact member 17, of the arc contact 8 and openings 33 in the shaft 7, in which the discharge duct 32 opens into the expansion volume 13, for a small proportion of the heated quenching gas to be able to escape only in the initial phase of arc formation.

In the compression volume 12 of the additional compression device, compressed quenching gas is generated as a function of the stroke of the compression slider 6. At the beginning of the switching-off movement, the comparatively short grooves 15 provide for some quenching gas to be able to escape from the compression volume 12 so that the compression pressure is built up with some delay and compressed quenching gas is available only when blasting of the arc is desired. Suitable dimensioning of the length of the discharge ducts 32 achieves at the same time that quenching gas heated even with comparatively weak arc currents reaches the heating volume 11 and is not completely removed through the discharge duct 32 into the expansion volume already in the heating phase. A suitable length dimensioning of the discharge duct 32 can be between c/32f and c/3f, where c is the velocity of sound of the quenching gas under filling conditions and f is the mains frequency of the current to be switched off. In the equation, the time units i.e., "seconds" are cancelled and the "cycle" units are ignored. Therefore, the length will be expressed as a distance i.e., feet, meters, or the like. It has been proved that such dimensioning makes it difficult for the quenching gas to flow off from the arc zone into the expansion space 13 if the arcing currents present are small. This could be due to the fact that with discharge ducts 32 dimensioned in this manner, the cool quenching gas located in the discharge duct 32 blocks the flowing off of the heated quenching gas located in the arc zone and encourages heated quenching gas to flow into the heating volume 11. This is because, in the heating phase of the arc, a condensing wave propagating with a velocity of sound c in the quenching gas forms in the arc zone, which wave is conducted along the discharge duct 32 and, with suitable dimensioning of the length of the discharge duct 32, is reflected as expansion wave at its end open towards the expansion space 13 in such a manner that the reflected expansion wave arrives back in the area of the arc zone approximately at the time of the zero transition of the current.

If the pressure of the quenching gas located in the heating volume 11 is nevertheless inadequate for sufficiently blasting the arc, the increased-pressure quenching gas generated in the compression volume 12 flows along a very short path directly into the heating volume 11 via the back-pressure valve 14. When the current approaches the zero transition, the compressed quenching gas located in the heating volume 11 reaches the quenching zone and produces a dual and thus particularly effective blasting of the arc as soon as the fixed arc contact 17 has cleared an opening 34 in the quenching chamber wall 10*a*.

During the actual compression process, the grooves are covered and therefore ineffective. However, it is possible that pressure peaks can occur during the compression process as a function of the actuating characteristic. These peaks can be controlled, without amplification of drive, by the excess-pressure valve 30 and/or by a comparatively large extent of the grooves 16 up to close to the grooves 15. Shortly before the switching-off position is reached, in a stroke region where the arc has already been quenched, and no further blasting is therefore necessary, the remaining compression pressure is removed to the expansion volume 13 via the grooves 16. As a result of this measure, the switch actuating energy needed and thus also the actuator itself can be kept particularly small.

If very high switching-off currents have to be interrupted, very high gas pressures occur in the heating volume 11 and the gas stored here is not by itself sufficient for blasting the arc until it is quenched. In this case, the back-pressure valve 14 does not need to open. Blocking of the weakly dimensioned actuator is avoided, nevertheless, since the entire compressed gas can flow from the compression volume 12 through the grooves 16 and/or the excess-pressure valve 30 into the expansion volume 13.

FIG. 2 shows an embodiment of the gas-blast switch derived from FIG. 1. Instead of the compression piston 9, compression slider 6 contains a compression piston with sleeve 20 and, instead of the end wall 4, a fixed piston 19 which is rigidly connected to the metal housing 3. The compression slider 6 slides in a sealing manner over the piston 19 and, together with the latter, encloses the compression volume 12. In the piston 19, the back-pressure valve 12*a* provided for filling the compression volume 12 is installed which permits the aspiration of the compression volume 12 to the expansion volume 13 when the switch is switched on. The arc contact 17 of the fixed contact member 17*a* is of hollow construction as a result of which the root of the arc is blasted particularly intensively at this arc contact.

The arrangement according to FIG. 2 has the advantage that both moving surfaces of the piston rings inserted into the piston 19 are shielded from the switching dust falling down from above. The moving surface of the inner piston ring is particularly well protected since the compressed gas flowing off through the grooves 15 and 16 into the gap 21 additionally keeps away contamination. If a part of the grooves 15 and 16 were to be shifted to the inside wall of the compression piston with sleeve 20, the moving surface of the outer piston ring could be protected in a similarly advantageous manner.

I claim:

1. A gas-blast switch, comprising:

a housing adapted to be filled with a quenching-gas, the housing being defined about an axial axis;

an expansion volume defined in and enclosed by said housing;

a first rated current contact and a first arc contact, a moving contact member having a second rated current contact and a second arc contact, the rated current contacts and the arc contacts being adapted to be, respectively, electrically connected to or disconnected from one another;

a quenching chamber housing coaxially surrounding said second arc contact;

an opening through said second arc contact, said opening communicating into said quenching chamber housing and being sized to permit said first arc contact to penetrate therethrough;

a heating volume defined in said quenching chamber housing and arranged coaxially about said second arc contact, the heating volume being operative for accommodating said quenching gas which is heated up by a switching arc developing in an interior of said quenching chamber housing during a switching-off operation associated with said gas-blast switch;

a compression volume defined coaxially about said moving contact member and a compression slider mounted at said quenching chamber housing for generating in said compression volume compressed quenching gas during said switching-off operation;

a back-pressure valve mounted at said compression slider at a location facing into said heating volume;

said second arc contact having a discharge duct which extends axially from said opening of said second arc contact and extending to another opening which communicates into said expansion volume which is defined about said moving contact member; and a pressure controlling device which communicates into said compression chamber and which is adapted to refill said compression chamber with quenching gas in response to preset conditions.

2. A gas-blast switch according to claim 1, wherein the length of said discharge duct measured between said opening and said another opening thereof is effective to create a standing pressure wave in said discharge duct during said switching-off operation.

3. A gas-blast switch according to claim 2, wherein said length of said discharge duct is greater than c/32f and smaller than c/3f, wherein c is the velocity of sound of the quenching gas and f is the mains frequency of the current to be switched off.

4. A gas-blast switch according to claims 1, 2 or 3 wherein said pressure controlling device comprises at least one excess pressure valve which is effective for controllably admitting said quenching gas into said compression chamber.

5. A gas-blast switch according to claim 4, further comprising first and second axially extended grooves, the first groove being adapted to provide fluid communication between said compression volume and said expansion volume in a switched-on position associated with said switch, the second groove being adapted to provide fluid communication between said compression chamber and said expansion chamber in a switched-off condition of said switch.

6. A gas-blast switch according to claim 5, wherein said first and second grooves are formed and extend at least partially along said moving contact member.

7. A gas-blast switch according to claim 5, wherein said first and second grooves are formed in a hollow cylinder wall which defines an exterior periphery of said compression volume.

8. A gas-blast switch according to claim 5, wherein said first and second grooves have a depth dimension which is greater than a width dimension associated with said grooves.

9. A gas-blast switch according to claim 1, wherein said switch comprises a fixed contact member said first arc contact being formed on said fixed contact, said first rated current contact having a hollow construction and being axially disposed about said fixed contact member and said second rated current contact being spaced from said first arc contact, and wherein, in a switched-on position associated with said switch, said first rated current contact is electrically engaged with said second rated current contact and said second arc contact is mounted to said moving contact member.

* * * * *